US006076658A

United States Patent [19]

Nicholson

[11] Patent Number: 6,076,658

[45] **Date of Patent: *Jun. 20, 2000**

[54] TOOTHPICK HOLDER

[76] Inventor: Jerome Nicholson, 275 Huntgate Cir., Newport News, Va. 23606

[ * ] Notice: This patent issued on a continued prosecution application filed under 37 CFR 1.53(d), and is subject to the twenty year patent term provisions of 35 U.S.C. 154(a)(2).

[21] Appl. No.: 09/004,864

[22] Filed: Jan. 9, 1998

[51] Int. Cl.[7] ..... B65D 85/24

[52] U.S. Cl. ..... 206/38.1; 206/380

[58] Field of Search ..... 206/37, 37.1, 37.4, 206/37.8, 38.1, 380, 581, 38, 443

[56] References Cited

U.S. PATENT DOCUMENTS

| | | | |
|---|---|---|---|
| D. 329,137 | 9/1992 | Hinson . | |
| D. 361,405 | 8/1995 | Tipp . | |
| D. 364,941 | 12/1995 | Saulsbury . | |
| D. 365,422 | 12/1995 | Hallam . | |
| D. 367,546 | 2/1996 | Dunn . | |
| D. 368,985 | 4/1996 | Tipp . | |
| 1,385,288 | 7/1921 | Walker | 206/380 |
| 1,648,448 | 11/1927 | Derrick | 206/380 |
| 1,832,735 | 11/1931 | Puyuelo | 206/380 |
| 3,151,740 | 10/1964 | Simon | 206/37 |
| 3,306,266 | 2/1967 | McCunney | 206/38.1 |
| 4,269,313 | 5/1981 | Smith | 206/380 |
| 4,925,018 | 5/1990 | Hajduk | 206/38.1 |

*Primary Examiner*—Jim Foster
*Attorney, Agent, or Firm*—Millen, White, Zelano & Branigan, P.C.

[57] ABSTRACT

A toothpick holder includes a tubular container defining a chamber which holds a plurality of toothpicks. The chamber has a closed end with a key ring loop projecting therefrom and an open end which is covered by a detachable cap. The detachable cap includes a resilient arm projecting therefrom which serves as a shirt pocket clip.

9 Claims, 1 Drawing Sheet

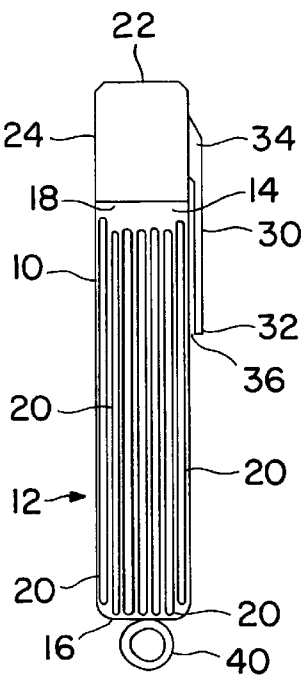
FIG. 1
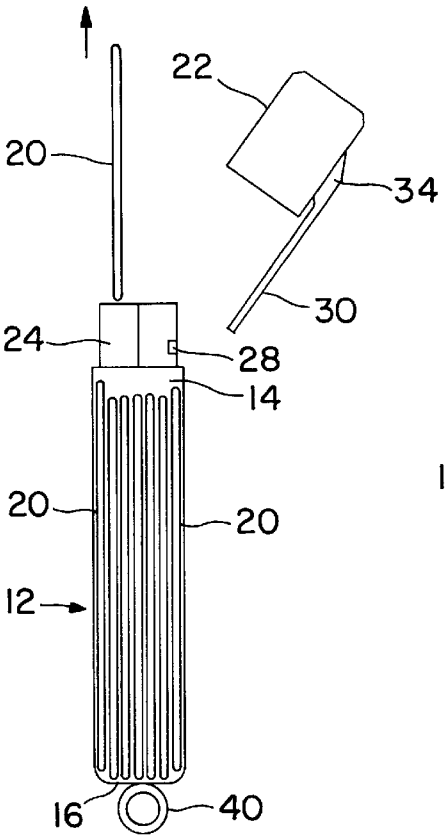
FIG. 2
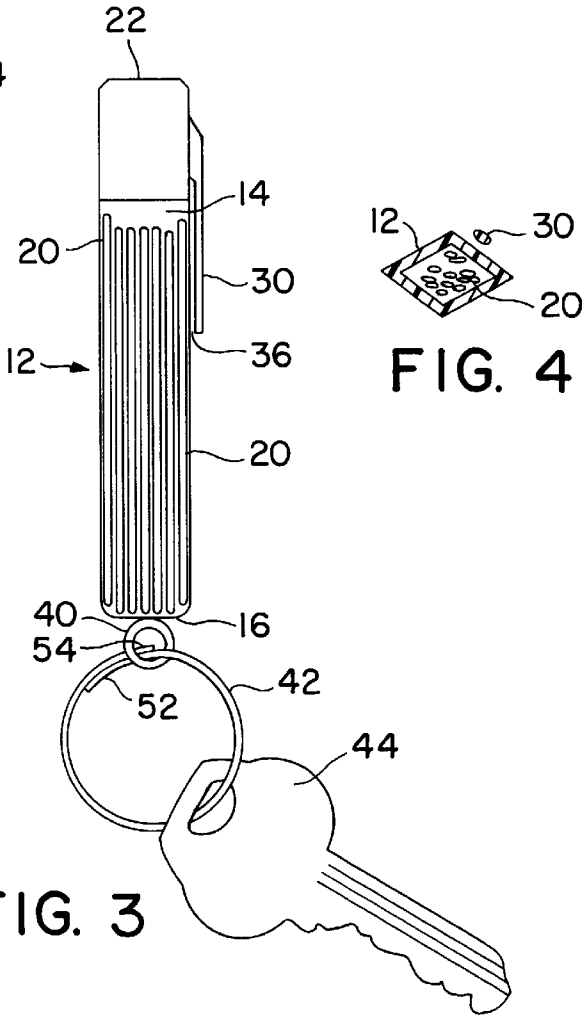
FIG. 3
FIG. 4

TOOTHPICK HOLDER

FIELD OF THE INVENTION

The present invention relates to toothpick holders. More particularly, the present invention relates to portable toothpick holders.

BACKGROUND OF THE INVENTION

Human beings have been using toothpicks for tens of thousands of years, the original toothpicks being twigs or slivers of wood or bone found just about everywhere. Tens of thousands of years before humans began brushing their teeth, this is the way the teeth were cleaned. In more recent times, people would use bristles from brooms, preferably the clean end of the bristle, as opposed to the business end.

Present day humans in developed societies, especially urban humans, are not likely to use twigs, broom bristles or any of the ubiquitous debris that is lying around all over the place to clean their teeth, but rather usually rely on a device known as the toothpick. Most toothpicks are in the form of wooden sticks, but also occasionally may be made of plastic. Toothpicks are usually available in homes and restaurants, but are frequently not available when needed at other locations. Since the urban dweller is not likely to pick up a little stick from the ground or to break one off from a sidewalk tree when bothered by food lodged between his or her teeth, there is a need for a convenient way to carry toothpicks on ones person. Due to their rather peculiar nature, it is not appropriate to carry toothpicks around in ones pocket, purse or wallet. This is because these places are usually contaminated with bacteria, spores in various other substances which find their way into ones pocket or purse by virtue of articles such as coins or erasures or many other things that tend to serve as carriers for microscopic hazards.

SUMMARY OF THE INVENTION

It is a feature of the present invention to provide a new and improved toothpick holder.

In view of this feature and other features, the present invention is directed to a toothpick holder which comprises a container having a compartment for holding toothpicks, a key ring attached thereto and a clip for attaching the container to ones clothes.

In a further aspect, the container is transparent so that one can tell whether or not their are toothpicks in the container.

In still a further aspect, the container has a cap with a shirt pocket clip fixed thereto which projects from the cap along a side surface of the container. In still a further aspect of the invention, there is a loop fixed to the container for holding a key ring, the key ring being optionally detachable from the loop.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 1 is a side view of the toothpick holder configured in accordance with the present invention;

FIG. 2 is a side view showing a cap removed from the toothpick holder so that a toothpick therein may be removed from the toothpick holder;

FIG. 3 is a side view showing the toothpick holder in combination with a key ring; and FIG. 4 is a cross-section of one embodiment of the toothpick holder.

DETAILED DESCRIPTION

Referring now to the drawings, there is shown a toothpick holder designated generally by the numeral 10 configured in accordance with the principles of the present invention. The toothpick holder comprises a substantially tubular container 12 which may have either a polygonal cross-section, a round cross-section, an oval cross-section or any other cross-section which provides a convenient or pleasing design. The container 12 has a chamber 14 which is closed by a bottom wall 16 and has an open top 18. Within the chamber 14 are a plurality of individual toothpicks 20 which are preferably in the form of wooden sticks, but may also be plastic.

The open top 18 of the container 12 is closed by a cap 22 which is slid over a projecting sleeve portion 24 of the container 12. The cap 22 may have a friction fit with the sleeve 24 or there may a more positive snap fit in which a detent on the inner wall of the cap 22 snap fits into an indentation 28 on the outer wall of the projection 24. In another embodiment, which may be useful if the container 12 is round, the cap 22 has internal threads (not shown) which allows the cap 22 to screw onto external threads (not shown) on the projecting sleeve 24.

The cap 22 has projecting therefrom a resilient arm 30. The resilient arm 30 has a free end 32 and an anchored end 34 that is unitary with or otherwise fixed to the cap. When the cap 22 is slid or otherwise mounted on the projecting sleeve 24, the resilient arm 30 extends over the exterior surface of the container 12 in spaced relation thereto to provide a gap 36. The gap 36 is designed to receive the edge of a pocket, such as a shirt pocket to retain the toothpick holder 10 on ones person.

Integral with the housing 12 is a loop 40. The loop 40 is fixed to the container 12. Attachable connected to the key ring loop 40 is a key ring 42 having keys 44 or some other implement, such as a pen knife, attached thereto. The key ring 44 is preferably a key ring which has overlapping laterally aligned ends 50 and 52, so that, upon spreading the ends 50 and 52, the key ring 42 is easily slipped onto the key ring loop 40.

The toothpick case 10 provides a convenient storage device which one may carry on ones person which makes toothpicks readily available to the person carrying the case when that person is not in locations where there is a supply of toothpicks. When the container 12 is empty, several toothpicks from any supply, such as a restaurant counter, may be used to replenish the toothpick holder. By having toothpicks on ones person which are readily available, the owner of this device, when smiled at by someone having debris between their teeth, can offer the person displaying the debris, a toothpick.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A toothpick holder comprising:

an elongated hollow container having at least a portion which is a transparent chamber therein in which a plurality of toothpicks are received, the container having a closed end and an open end;

a unitary cap detachably fitted over the open end to retain the toothpicks in the chamber, the cap having a resilient arm attached over thereto and extending therefrom over the container to provide a shirt pocket clip;

a key ring loop fixed to the container; and a key ring in the key ring loop.

2. The toothpick holder of claim 1, wherein the cap is slid axially onto the container without rotation.

3. The toothpick holder of claim 2, wherein the cap fits over an end portion of the container and does not extend inside of the container.

4. The toothpick holder of claim 3, wherein the container and cap are made of plastic.

5. The toothpick holder of claim 4, wherein the end of the container over which the cap is received is relieved.

6. The toothpick holder of claim 5, wherein the relieved portion includes a detent which provides a snap fit between the cap and container.

7. The toothpick holder of claim 1, wherein the container and cap are both of plastic material with the opening arm being unitary with the cap.

8. The toothpick holder of claim 1, wherein the cap slides over the open end of the container.

9. The toothpick holder of claim 8, wherein the container includes a supply of toothpicks therein and wherein there is at least one key on the key ring.

* * * * *